US007051460B2

(12) United States Patent
Orei et al.

(10) Patent No.: US 7,051,460 B2
(45) Date of Patent: May 30, 2006

(54) LIGHT WEIGHT SHOES

(75) Inventors: Takeshi Orei, Osaka (JP); Takeshi Matsuzaki, Osaka (JP); Tetsuo Yamamoto, Osaka (JP)

(73) Assignee: Mizuno Corporation, Osaka (JP)

( * ) Notice: Subject to any disclaimer, the term of this patent is extended or adjusted under 35 U.S.C. 154(b) by 114 days.

(21) Appl. No.: 10/749,454

(22) Filed: Dec. 31, 2003

(65) Prior Publication Data

US 2005/0081402 A1 Apr. 21, 2005

(30) Foreign Application Priority Data

Jan. 10, 2003 (JP) ..... 2003-004903
Nov. 25, 2003 (JP) ..... 2003-394141

(51) Int. Cl.
*A43B 1/02* (2006.01)
*A43B 7/06* (2006.01)
*A43B 23/00* (2006.01)
*A43B 23/26* (2006.01)

(52) U.S. Cl. ..... 36/84; 36/3 A; 36/45; 36/54; 36/9 R

(58) Field of Classification Search ..... 36/84, 36/88, 97, 3 A, 45, 48, 9 R, 54
See application file for complete search history.

(56) References Cited

U.S. PATENT DOCUMENTS 1,956,969 A * 5/1934 Ayers ..... 36/45
4,785,559 A * 11/1988 Hentschel ..... 37/189
5,345,638 A * 9/1994 Nishida ..... 36/45
5,385,036 A * 1/1995 Spillane et al. ..... 602/63
5,566,396 A * 10/1996 Leib ..... 2/239
6,401,364 B1 * 6/2002 Burt ..... 36/3 A
6,482,492 B1 * 11/2002 Hung ..... 36/3 A
6,630,414 B1 * 10/2003 Matsumoto ..... 442/1
6,931,762 B1 * 8/2005 Dua ..... 36/9 R

FOREIGN PATENT DOCUMENTS

JP 5-176804 7/1993
JP 05176804 A * 7/1993
JP 2548713 9/1997

* cited by examiner

*Primary Examiner*—Anthony Stashick
(74) *Attorney, Agent, or Firm*—Hamre, Schumann, Mueller & Larson, P.C.

(57) ABSTRACT

A shoe including an upper material using a double raschel warp knitted fabric is provided. The upper material includes a first surface having a non-mesh structure and a second surface having a non-mesh structure part (A) and mesh structure parts (B, C). The burst strengths burst strengths A, B and C of the parts (A, B and C) satisfy the relationship: A>B>C. The non-mesh structure part (A) is disposed in a part surrounding the tiptoe, a part connecting to a shoe sole and disposed in both sides of the foot for example, in a stripe. The mesh structure part (B) is disposed in the vicinity of the surface of the toe and the mesh structure part (C) is disposed in the both sides of the foot for example, in a stripe. Thus, a shoe having lightweight, air permeability and durability and a double raschel knitted fabric used for the shoe are provided.

7 Claims, 5 Drawing Sheets

LIGHT WEIGHT SHOES

FIELD OF THE INVENTION

The present invention relates to shoes. More particularly, the present invention relates to shoes incorporating a double raschel warp knitted fabric.

BACKGROUND OF THE INVENTION

Conventionally, a warp knitted fabric, a woven fabric, a mesh material, and the like, have been used for shoes (see, for example, application for utility model registration No. 2548713, JP 5(1993)-176804A). In particular, in sport shoes, properties such as lightweight and air permeability are required. A warp knitted fabric having a mesh structure is preferred with respect to the above-mentioned properties, but, on the other hand, it does not have a satisfactory strength and needs reinforcement as a whole. At the present, in most cases, such reinforcement is carried out by using artificial leather, leather, a resin sheet, resin, a woven fabric, and the like, from the side of the front surface. Therefore, in general, the usual weight of one sport shoe is about 150 g to 500 g.

However, the weight of the conventional sport shoe is heavy for use in marathon, running, and indoor sports such as badminton, ping-pong, etc. Therefore, there is a demand for shoes having lighter weight.

SUMMARY OF THE INVENTION

With the foregoing in mind, in order to solve the above-mentioned conventional problem, it is an object of the present invention to provide a shoe having lightweight and air permeability and also having high durability, and a double raschel warp knitted fabric used for the shoe.

In order to achieve the above-mentioned object, a shoe of the present invention includes an upper material using a double raschel warp knitted fabric. The upper material includes a first surface having a non-mesh structure and a second surface having a non-mesh structure part (A) and mesh structure parts (B, C); the burst strengths A, B and C of the parts (A, B and C) satisfy the relationship: A>B>C; the non-mesh structure part (A) is disposed in a part surrounding the tiptoe and partially in both sides of the foot; the mesh structure part (B) is disposed in the vicinity of the surface of the toe; and the mesh structure part (C) is disposed partially in the both sides of the foot.

Another shoe of the present invention including an upper material using a double raschel warp knitted fabric. The upper material includes a front surface including a mesh structure part and a back surface having a non-mesh structure; and a constituent yarn of the front surface includes a yarn having a melting point that is lower than the melting point of a constituent yarn of the back surface, and at least a part of the front surface is partially fused.

Another aspect of the present invention relates to a double raschel warp knitted fabric adapted for use with a shoe. The warp knitted fabric includes one surface having a non-mesh structure and another surface having a non-mesh structure part (A) and mesh structure parts (B, C); the burst strengths A, B and C of the parts (A, B and C) satisfy the relationship: A>B>C; the non-mesh structure part (A) is disposed in a part surrounding the tiptoe and partially in both sides of the foot; the mesh structure part (B) is disposed in the vicinity of the front surface of the toe; the mesh structure part (C) is disposed partially in the both sides of the foot; and at least the parts A to C are disposed in one continuous knitted fabric.

DETAILED DESCRIPTION OF THE INVENTION

Figure 1:
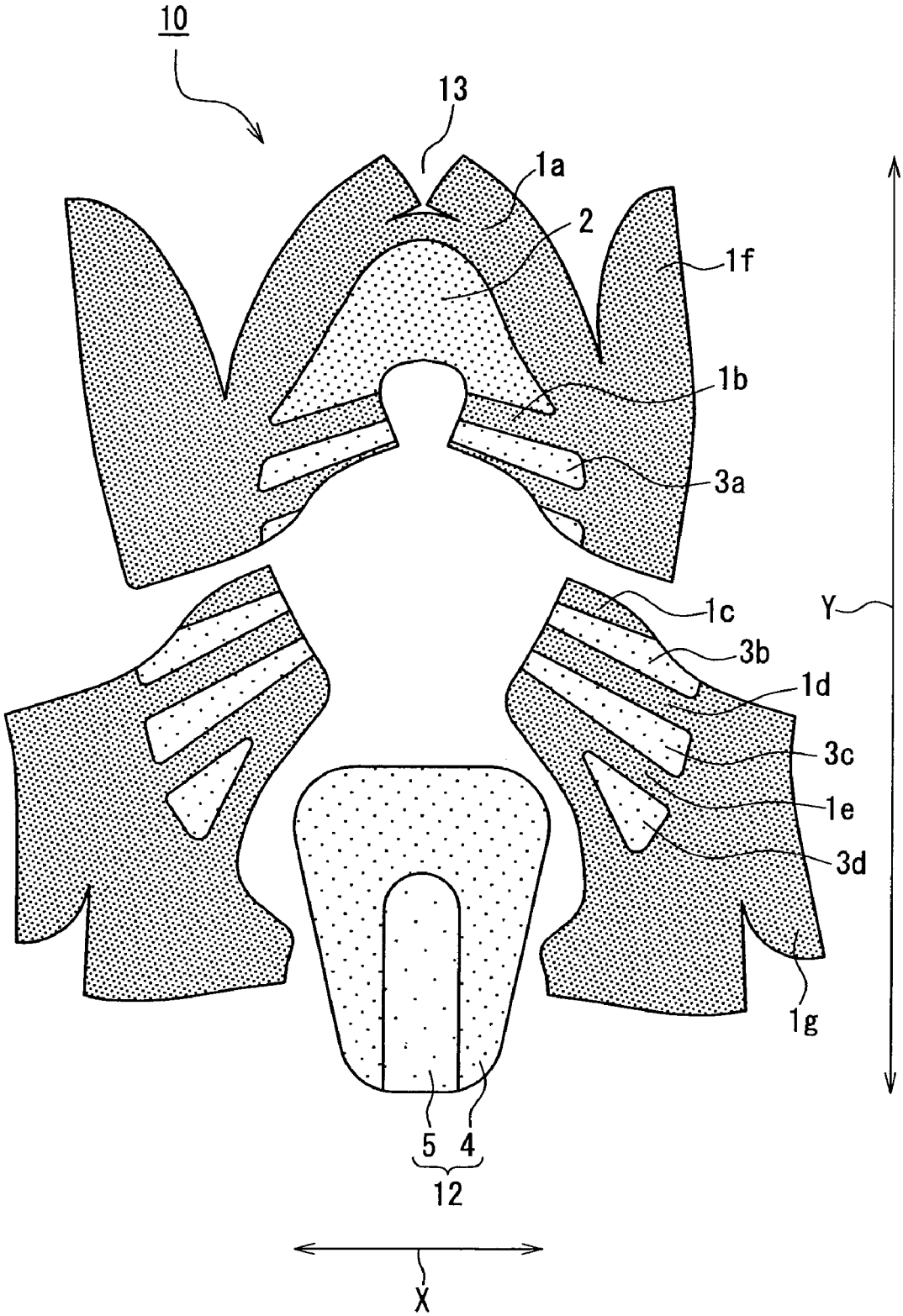
FIG. 1 is a plan view showing a shoe pattern using a double raschel warp knitted fabric according to Embodiment 1 of the present invention.

The present invention relates to a shoe including an upper material using a double raschel warp knitted fabric. The double raschel warp knitted fabric is a three-layer warp knitted fabric including a base fabric for a front surface, a base fabric for a back surface and a connecting yarn connecting the front surface to the back surface. This warp knitted fabric is knitted by using a warp knitting machine with a double needle line so that the base fabric for a first surface is knitted as a derivative weave that is jacquard-controlled so as to include a non-mesh structure part (A) and mesh structure parts (B, C) and the base fabric for a second surface is knitted as a homogeneous non-mesh structure. The second surface may be formed of one weave and may be formed with different weave mixed. A warp knitting machine for knitting this knitted fabric is commercially available from KARL MAYER Textilmaschinenfabrik GmbH in Germany (NIPPON MAYER LTD. (a Japan corporation) is included).

When the surface including the non-mesh structure part (A) and mesh structure parts (B, C) of the knitted fabric is used for the front surface of a shoe, the shoe has an excellent appearance and furthermore, a surface area is increased, thus improving air permeability. On the contrary, when the second surface having a non-mesh structure is used for the front surface of the shoe, water can easily be prevented from entering the shoe from the surface.

The burst strengths A, B and C of the parts (A, B and C) of the double raschel warp knitted fabric satisfy the relationship: A>B>C. The non-mesh structure part (A) is disposed in a part that requires a high strength, that is, a part surrounding the tiptoe (i.e., a tiptoe region of the shoe) and a part connecting to a shoe sole, and also to parts that face the sides of the foot (i.e., side regions of the shoe), the non-mesh structure part (A) is disposed in a stripe. Furthermore, to a part that may have moderate strength and air permeability, that is, a part in the vicinity of the surface of the toe (i.e., a toe region of the shoe), the mesh structure part (B) is placed. Furthermore, to a part that needs air permeability, that is, the side surfaces of the foot (both sides), the mesh structure part (C) is placed, for example, in a stripe. Thus, as a whole, in the shoe, air permeability and durability are balanced.

The burst strength according to the bursting test based on the JIS L 1096 A of the non-mesh structure part (A) is preferably about 1400 kPa to 1550 kPa with respect to shoes such as marathon shoes, in which lightweight is particularly required. With respect to general shoes for running or jogging, the burst strength is preferably about 1600 kPa. Furthermore, with respect to shoes for a heavy use, for example, shoes for indoor sports such as badminton, ping-pong, etc., the burst strength is preferably about 2400 kPa.

It is preferable that the burst strength of the mesh structure part (C) is in the range from 900 kPa to 1000 kPa. The mesh structure part (B) may have any burst strength between the burst strength of (A) and that of (C).

It is preferable that a tiptoe region, a heel region and an eyelet part of the sport shoe are reinforced. Among the above-mentioned parts, the heel part may not be reinforced in the case where lightweight is particularly important.

It is preferable that a tongue part of the sport shoe includes the mesh structure part (C). It is further preferable that the tongue part may include a mesh structure part (D) having a burst strength that is lower than that of the part (C).

The double raschel warp knitted fabric may have a property of being stretchable in the width direction of the foot and not stretchable in longitudinal direction of the foot. Thus, the effect of allowing a size of a shoe to be stable and preventing the tiptoe part from stretching when the toe touches to the part at the time of wearing. On the contrary, a property of not being stretchable in the width direction of the foot and stretchable in the longitudinal direction of the foot may be provided. Thus, fitness can be provided in the direction of the width. Furthermore, when a shoe is manufactured by a process called a lasting method, in particular, the manufacturing process of the side part can be carried out easily.

At least the parts A to C of the double raschel warp knitted fabrics of the present invention are disposed as one continuous knitted fabric. Thus, when the fabrics are cut together with paper pattern, a shoe can be formed, thus enabling the efficiency in the formation to be improved.

Then, on another surface of the upper material (corresponding to an instep cover) of the present invention, a fiber with a low melting point is used and at least a part thereof is fused. Since the fused part is reinforced by fixing knit stitches, in the case of reinforcing a part with which the calx is brought into contact or a part with which the both sides of the foot are brought into contact, by heating only these parts from the outside, the knit stitch can be reinforced. In this case, it is important that only outside of the upper material is fused. The inner surface side of the upper material is not preferably fused in order to maintain a flexible state because this side covers the foot. An example of the fiber with a low melting point includes, for example, an ethylene vinyl alcohol fiber yarn but is not limited thereto. It is preferable to use fibers whose melting point is 150° C. to 200° C. The fiber with a low melting point may be used for an entire surface of the front surface of the double raschel warp knitted fabric. The fiber with a low melting point can be produced by mixing together with a fiber with 20 wt. % or more of high melting point material such as polyester. In the case of polyethylene terephthalate, the melting point is 260° C.

A constituent yarn of the back surface of the double raschel warp knitted fabric and a connecting yarn connecting the front surface to the back surface are preferably a polyester fiber yarn, and more preferably a polyethylene terephthalate fiber yarn. The other configuration of the present invention may be the same as that of the basic invention mentioned above.

The present invention can provide a shoe having lightweight and air permeability and further having high durability, and a double raschel warp knitted fabric used therefor.

EXAMPLE

Hereinafter, the present invention will be explained in more detail by way of Examples. Note here that the present invention is not limited to the following Examples.

Example 1

FIG. 1 shows a double raschel warp knitted fabric (thin melon-net fabric and back-woven half-net) used for a sport shoe according to one Example of the present invention. Shoe patterns 10 matched to paper patterns are placed continuously on one knitted fabric as shown in FIG. 1. In the shoe patterns 10, a non-mesh structure part (A) 1*a* to 1*e* are disposed in a part surrounding the tiptoe and a part connecting to the shoe sole and stripe-shaped parts on the side surface of the foot (both sides). That is to say, 1*a* denotes a part surrounding the tiptoe and connected to the shoe sole; 1*b* to 1*e* denote stripe-shaped parts arranged on both surfaces of the foot (both sides); and 1*f* to 1*g* denote parts folded in the shoe sole. A cut 13 at the tip is a part that becomes circular shape at the site of the tiptoe when folded into the shoe sole. A constituent yarn of a front surface and a back surface of this double raschel warp knitted fabric was a multifilament fiber yarn of polyethylene terephthalate (total diameter of fibers: 84 dtex and number of filaments: 24) and a connecting yarn connecting the front surface to the back surface was a monofilament fiber yarn made of polyethylene terephthalate (total diameter of fibers: 33 dtex and number of filament: 1). Gauge of a knitting machine was 24 gauges, and the weight per unit area of an entire knitted fabric was 258.4 g/m$^2$.

To a part that may have a moderate strength and air permeability, that is, a part in the vicinity of the surface of the toe, a mesh structure part (B) 2 was placed.

To a part that needs air permeability, that is, the side surfaces of the foot (both sides), mesh structure parts (C) 3*a* to 3*d* were placed in a stripe.

A tongue part 12 was formed of a mesh structure part (C) 4 and a mesh structure part (D) 5 with higher air permeability.

The back surface was formed of the same weave as that of the non-mesh structure part (A) of the front surface.

This double raschel warp knitted fabric had a structure that is stretchable in the X direction and not stretchable in the Y direction.

When the bursting test was carried out in accordance with JIS L 1096 A method, the burst strength of the non-mesh structure part (A) was 1600 kPa; the burst strength of the mesh structure part (B) was 1500 kPa; the burst strength of the mesh structure part (C) was 1000 kPa; and the burst strength of the mesh structure part (D) was 930 kPa. When the air permeability test was carried out in accordance with the JIS L 1096 A method ("Frazil method"), air permeability of the non-mesh structure part (A) was 240 cm$^3$/cm$^2$/s; air permeability of the mesh structure part (B) was 255 cm$^3$/cm$^2$/s; air permeability of the mesh structure part (C) was 278 cm$^3$/cm$^2$/s; and air permeability of the mesh structure part (D) was 340 cm$^3$/cm$^2$/s. The thickness of this knitted fabric was 5 mm. Furthermore, the weight of double raschel warp knitted fabric used for one shoe was 20 g (in the case of 26.0 cm-shoe).

Example 2

Figure 2:
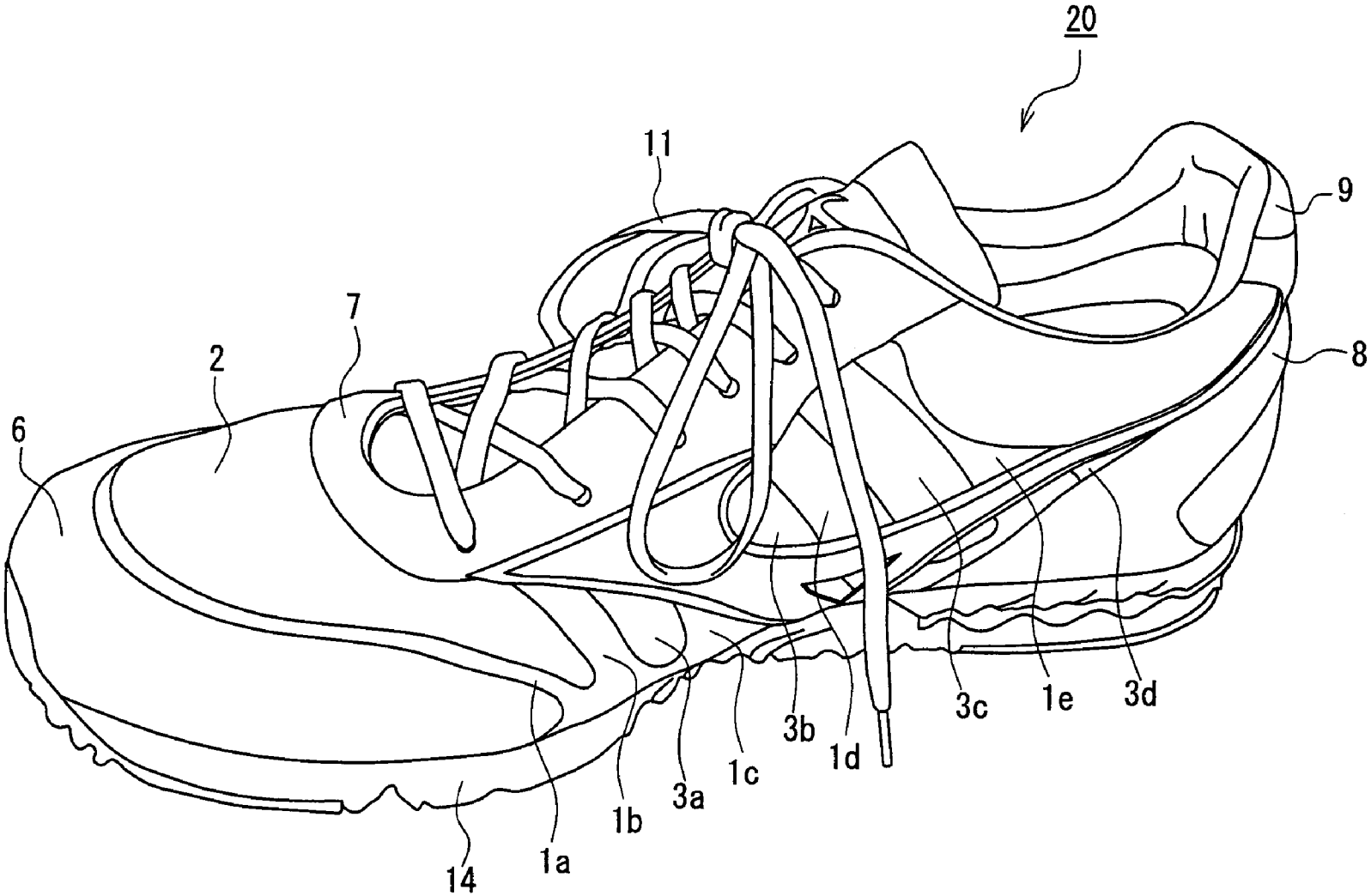
FIG. 2 is a side view showing a sport shoe according to Embodiment 2 of the present invention.
Figure 3:
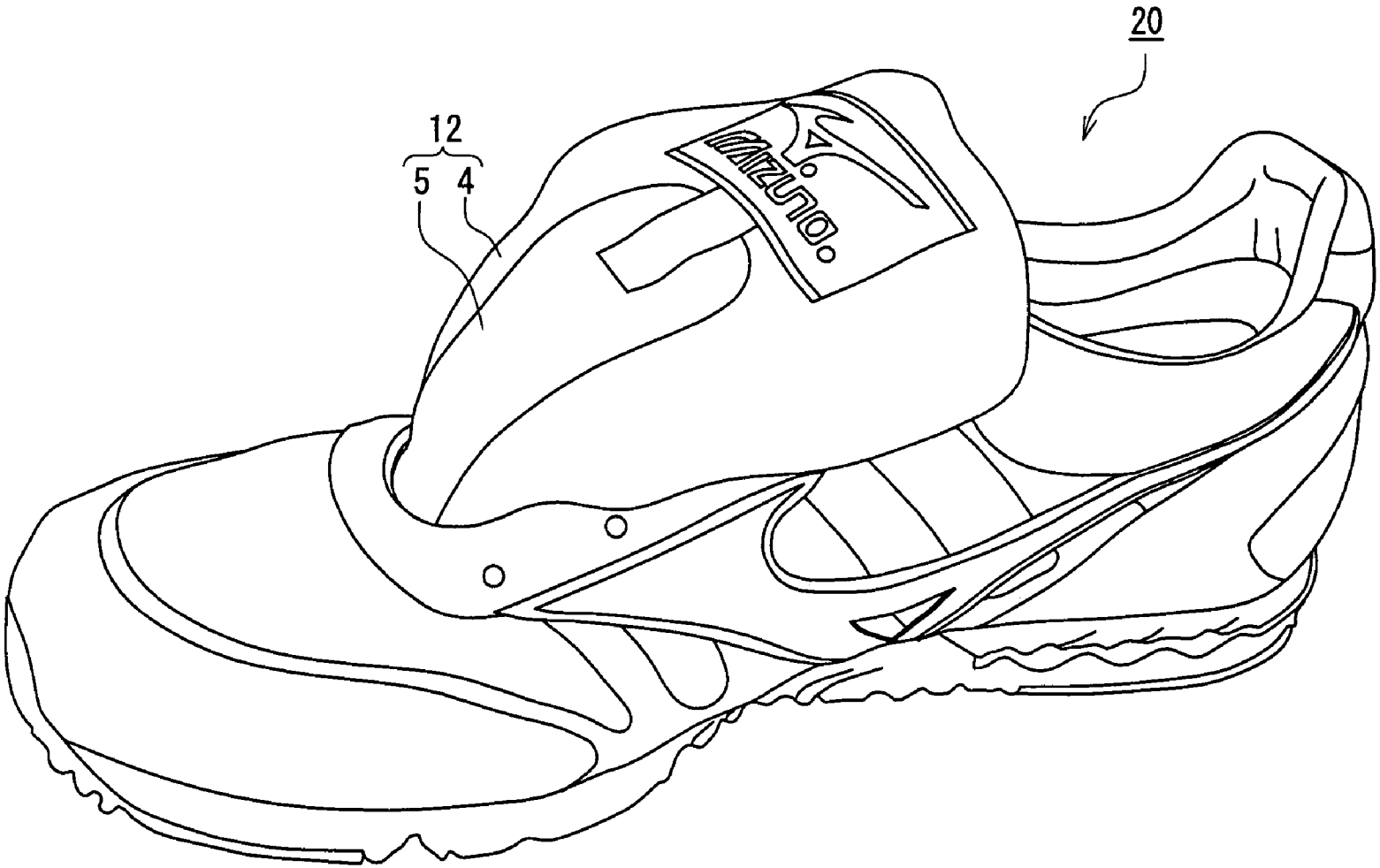
FIG. 3 is a perspective view showing the shoe shown in FIG. 2 when a tongue part is taken out of the shoe.
Figure 4:
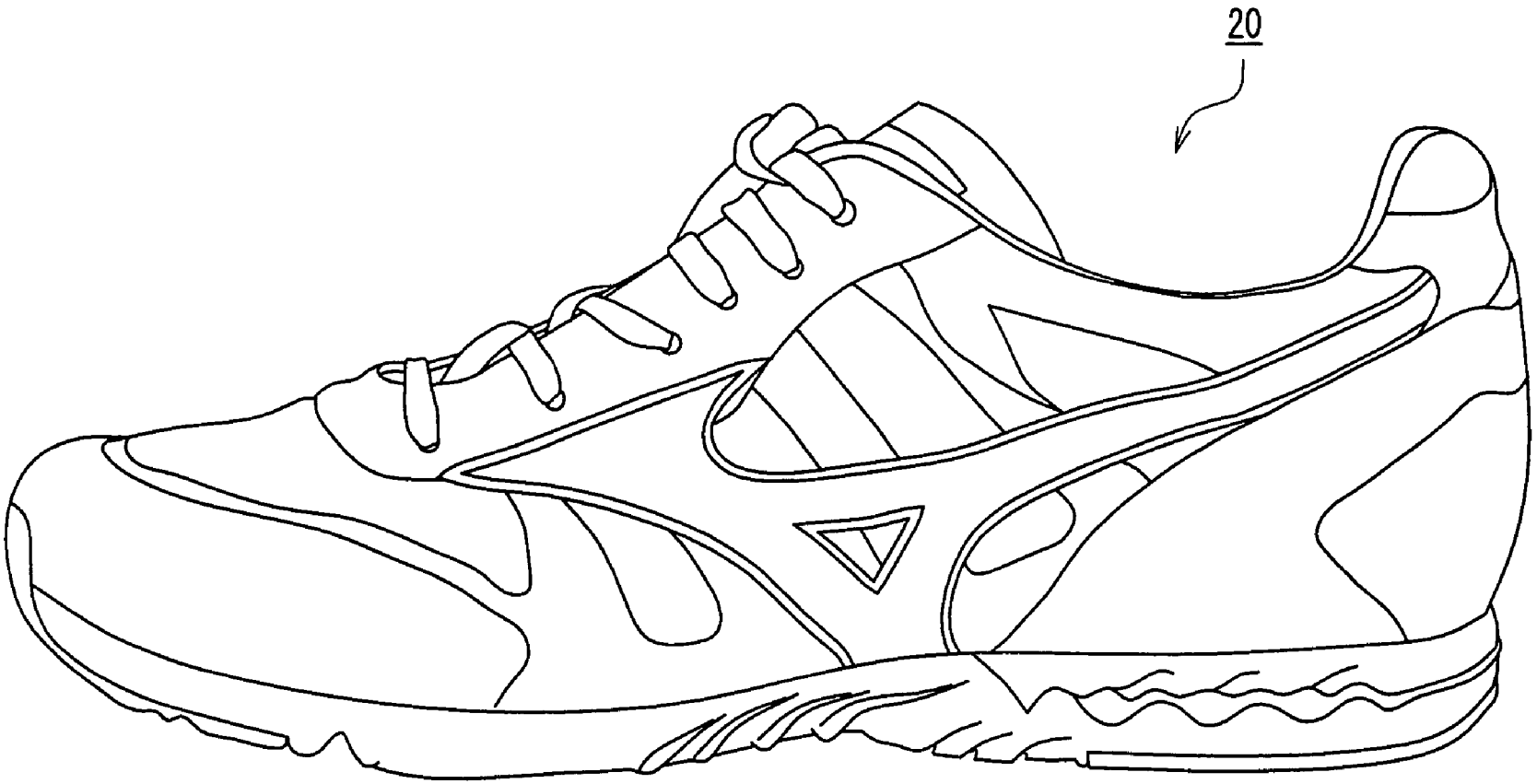
FIG. 4 is a side view showing the shoe of FIG. 2 seen from the opposite side.

Sport shoes were formed by using the warp knitted fabrics obtained in Embodiment 1. FIG. 2 is a side view showing a shoe for a right foot. References numerals given to elements except for the elements of the shoe pattern in FIG. 1 will be mentioned below. Reference numeral 6 denotes a reinforcing cloth (artificial leather) for a tiptoe part; 7 denotes a reinforcing cloth (artificial leather) for reinforcing eyelets for shoelace 11; 8 denotes a leather part for reinforcing the calx; 9 denotes a cushion part for covering the tarsus; and 14 denotes a shoe sole part formed of synthetic elastomer (EVA resin). FIG. 3 is a perspective view showing the shoe of FIG. 2 when the tongue portion is taken out of the shoe. FIG. 4 is a side view showing the shoe of FIG. 2 seen from the opposite side.

The weight of a 26-cm shoe was 133.1 g, which was significantly lighter as compared with the weight of about 150 g to 200 g of one of the conventional sport shoes of the same kind. This reduction in weight can be achieved by reducing the upper material by minimizing the amount of reinforcing materials as possible and by disposing a part requiring a satisfactory strength and a part requiring air permeability on one continuous warp knitted fabric so as to reduce sewing parts.

A test in terms of feeling of wearing, air permeability and durability was carried out by actually wearing the formed 26-cm shoes for one month. As a result, it was confirmed that the feeling of wearing, air permeability and durability were good and that the shoes had excellent functional properties as sport shoes. In particular, the shoes were suitable as shoes to be worn in long-distance running such as marathon.

Example 3

Figure 5:
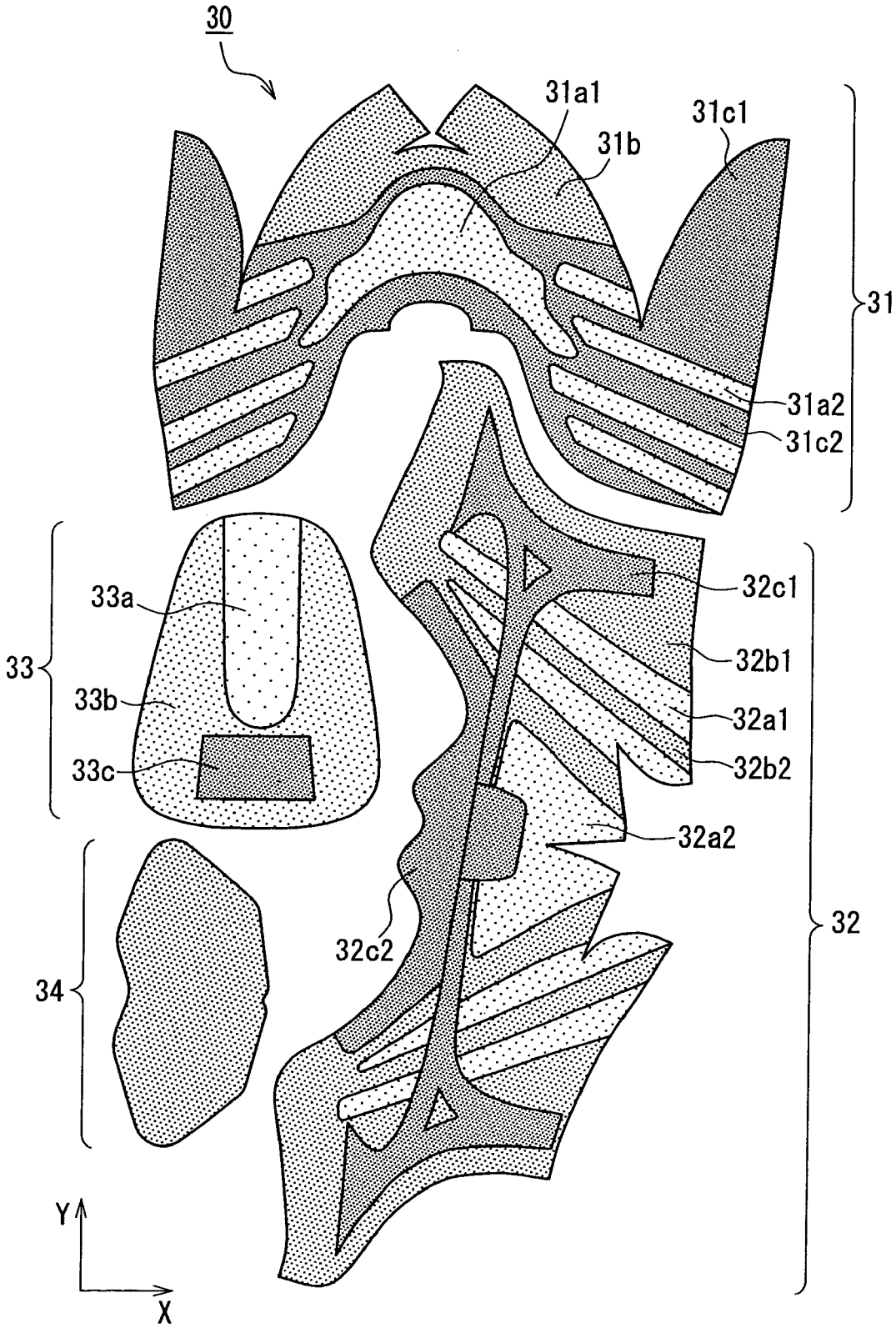
FIG. 5 is a plan view showing a shoe pattern using a double raschel warp knitted fabric according to Embodiment 3 of the present invention.

FIG. 5 shows double raschel warp knitted fabric (thin melon-net fabric and back-woven half-net) used for sport shoes according to one Example of the present invention. A constituent yarn of a front surface of the double raschel warp knitted fabric is a multi-filament yarn made of ethylene vinyl alcohol (total diameter of fibers: 84 dtex, number of filaments: 24, amount of yarns: 78.76 g/m$^2$, and total ratio: 30.4%), and a constituent yarn of the back surface of the double raschel warp knitted fabric is a multi-filament yarn made of polyethylene terephthalate (total diameter of fibers: 84 dtex, number of filaments: 24, amount of yarns: 94.52 g/m$^2$, and total ratio: 36.5%); and a connecting yarn connecting the front surface to the back surface is a monofilament fiber yarn made of polyethylene terephthalate (total diameter of fibers: 33 dtex, number of filament: 1, amount of yarns: 85.73 g/m$^2$, and total ratio: 33.1%). Gauge of a knitting machine was 24 gauges, and the weight per unit area was 259.0 g/m$^2$. The thickness of this knitted fabric was 5 mm.

In FIG. 5, reference numeral 30 denotes a shoe pattern on knitted fabric. On one knitted fabric, respective parts are placed continuously. For reducing the excess parts so as to increase the yield, the arrangement is changed from that shown in FIG. 1. Reference numeral 31 denotes a part for covering the anterior side of the foot and 32 denotes a part for covering the posterior side of the foot. The configuration is different from that shown in FIG. 1 in that two parts are combined into one continuous part. Reference numeral 33 denotes a tongue part; and 34 denotes a part to be attached to the posterior side face of the calx. The burst strength of each part is substantially the same as that in Example 1. The number of meshes (the number of holes per inch (25.4 mm)) is described below. In the below explanation, X direction denotes a width direction and Y direction denotes a longitudinal direction in FIG. 5.

(1) a part 31*a*1 located above the toe, stripe parts 31*a*2 and 32*a*1 of the side part of the foot, a part 32*a*2 for covering the calx, and a part through which a shoelace passes in a tongue part 33*c:* 5.5 meshes in the lateral direction and 3 meshes in the longitudinal direction (2) a tip part 31*b* of the toe, a side part 32*b*1 of the foot and a stripe part 32*b*2, and a part 34 to be attached to the side face of the posterior side of the calx: 11 meshes in the lateral direction and 6 meshes in the longitudinal direction (3) an anterior side 31*c*1 folded into a shoe sole and a stripe part 31*c*2, a reinforcing part 32*c*1 of a side part of the calx and an edge part 32*c*2: 12 meshes in the lateral direction and 12 meshes in the longitudinal direction (4) a central part 33*a* of the tongue part: 5 meshes in the lateral direction and 2 meshes in the longitudinal direction.

(5) a part 33*b* except for a central part and a part through which a shoelace passes: 6 meshes in the lateral direction and 3.5 meshes in the longitudinal direction.

This double raschel warp knitted fabric has a structure that is not stretchable in the X direction and the Y direction.

A shoe that is the same as that shown in FIGS. 2 to 4 is formed by using the shoe patterns 30 of a knitted fabric. Thereafter, side parts of the foot corresponding to the parts 1*c* and 1*d* of FIG. 2 are fused and processed by heating thereof at 170° C. As a result, in the heated part, knit stitch structure became rigid, and thus reinforcement can be carried out.

The weight of one of the obtained 26-cm shoes was 133 g. A test in terms of feeling of wearing, air permeability and durability was carried out by actually wearing the formed 26-cm shoes for one month. As a result, it was confirmed that the feeling of wearing, air permeability and durability were good and that the shoes had excellent functional properties as sport shoes. In particular, the shoes were suitable as shoes to be worn in long-distance running such as marathon.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A shoe comprising:

an upper material using a double raschel warp knitted fabric;

the upper material including a first surface having a non-mesh structure and a second surface having a non-mesh structure part (A) and mesh structure parts (B, C);

the non-mesh structure part (A) and the mesh structure parts (B, C) respectively having burst strengths A, B and C that satisfy the relationship: A>B>C;

the shoe including a tiptoe region, a toe region positioned adjacent to the tiptoe region, a heel region, and two side regions that extend between the heel and toe regions;

the non-mesh structure part (A) being disposed at the tiptoe region and partially at both side regions;

the mesh structure part (B) being disposed adjacent the toe region; and the mesh structure part (C) being disposed partially at both side regions.

2. The shoe according to claim 1, wherein in accordance with a bursting test based on JIS L 1096A Method, the burst strength of the non-mesh structure part (A) is 1400 kPa or more and the burst strength of the mesh structure part (C) is 900 kPa to 1200 kPa.

3. The shoe according to claim 1, wherein the tiptoe region, the heel region and an eyelet part of the shoe are reinforced.

4. The shoe according to claim 1, wherein a tongue part of the shoe comprises the mesh structure part (C).

5. The shoe according to claim 1, wherein a constituent yarn of the first surface and the second surface, and a connecting yarn connecting the first surface to the second surface are polyester fiber yarns.

6. A shoe comprising:

a double raschel warp knitted fabric including one surface having a non-mesh structure and another surface having a non-mesh structure part (A) and mesh structure parts (B, C);

the non-mesh structure part (A) and the mesh structure parts (B, C) including burst strengths A, B and C satisfy the relationship: A>B>C;

the shoe including a tiptoe region, a toe region positioned adjacent to the tiptoe region, a heel region, and two side regions that extend between the heel and toe regions;

the non-mesh structure part (A) being disposed at the tiptoe region and partially at the side regions of the shoe;

the mesh structure part (B) being disposed in the vicinity of the toe region of the shoe;

the mesh structure part (C) being disposed partially at the side regions of the shoe; and at least the parts A to C being disposed in one continuous knitted fabric.

7. The shoe according to claim 6, wherein a constituent yarn of the first surface and the second surface and a connecting yarn connecting the first surface to the second surface is a polyester fiber yarn.

* * * * *